United States Patent [19]

Vanek et al.

[11] Patent Number: 4,484,595

[45] Date of Patent: Nov. 27, 1984

[54] TAMPER-PROOF COVER FOR THE OPERATING NUT OF A FIRE HYDRANT

[76] Inventors: Kenneth F. Vanek, 567 Crestview, East Alton, Ill. 62024; Joseph S. Dooling, 507 N. Woodriver Ave., Woodriver, Ill. 62095

[21] Appl. No.: 596,045

[22] Filed: Apr. 2, 1984

[51] Int. Cl.[3] ..... E03B 9/06; E03B 9/14

[52] U.S. Cl. ..... 137/296; 137/382; 137/800; 220/85 P

[58] Field of Search ..... 137/296, 382, 382.5, 137/800; 220/85 R, 284, 285, 286

[56] References Cited

U.S. PATENT DOCUMENTS

| | | | |
|---|---|---|---|
| 2,118,233 | 5/1938 | Ruggio | 137/296 |
| 3,453,655 | 7/1969 | Quinones et al. | 137/296 |
| 3,626,961 | 12/1971 | Quinones | 137/296 |
| 3,706,401 | 12/1972 | Gach | 220/85 P |
| 3,709,249 | 1/1973 | Diaz | 137/296 |
| 3,916,939 | 11/1975 | Gillard | 137/296 |
| 4,369,807 | 1/1983 | Camp | 137/296 |

FOREIGN PATENT DOCUMENTS

| | | | |
|---|---|---|---|
| 619436 | 9/1935 | Fed. Rep. of Germany | 137/296 |

*Primary Examiner*—George L. Walton

*Attorney, Agent, or Firm*—Senniger, Powers, Leavitt and Roedel

[57] ABSTRACT

A tamper-proof cover for the operating nut of a fire hydrant comprising a housing and an operating member. The housing has an internal flange and is adapted to be positioned on the bonnet of the hydrant over and around the operating nut so that the operating nut is substantially concealed. The operating member has an opening therein for receiving the nut and is adapted to be placed on the operating nut within the housing. The operating member opening has a shape generally corresponding to that of the nut for preventing relative rotation between the operating member and the operating nut when the operating member is on the nut. A screw secures the operating member against removal from the operating nut. The flange of the housing is engageble with the operating member when the latter is secured to the nut for preventing removal of the housing from the bonnet. Also disclosed is a socket for turning the operating member and operating nut.

17 Claims, 3 Drawing Figures

TAMPER-PROOF COVER FOR THE OPERATING NUT OF A FIRE HYDRANT

BACKGROUND OF THE INVENTION

This invention relates generally to protective devices for a fire hydrant, and more particularly to a tamper-proof cover for the operating nut of a fire hydrant.

The unauthorized operation of fire hydrants is a common urban problem having possibly severe consequences, such as the waste of large quantities of water and the resulting substantial drop in an area's water pressure. Moreover, such tampering oftentimes result in damage to or loss of the operating nut of the fire hydrant.

There have been a number of attempts to protect the operating nut of the hydrant from access by unauthorized persons. For example, U.S. Pat. No. 2,118,233 granted May 24, 1938 discloses a hydrant guard having a cap held above the operating nut of the hydrant by means of downwardly depending legs. The legs are secured at their lower ends to a flange at the base of the bonnet. The top of the cap has a central opening therein for access to the operating nut.

U.S. Pat. No. 3,453,655 dated Dec. 19, 1966 discloses a dome-shaped guard integrally formed with the bonnet of a hydrant. The guard has a top opening in it through which a wrench with a socket member may be inserted for turning the nut.

U.S. Pat. No. 3,709,249 issued Jan. 9, 1973 shows an anti-tamper device for a fire hydrant comprising a washer which encircles the operating nut of the hydrant and rests on the bonnet of the hydrant, a cylindric collar around the operating nut having a circular shoulder at its upper end, the bottom of the collar being engageable at its lower end with the washer, and an externally threaded ring which encircles the collar below the shoulder of the collar. The device further includes an outer member having a closed top and an internally threaded skirt which is threadably engageable with the ring for concealing the operating nut from view. A special wrench is used to turn the operating nut.

Reference may also be made to U.S. Pat. Nos. 3,914,966 and 4,398,556 which disclose protective devices generally in the field of this invention.

SUMMARY OF THE INVENTION

Among the several objects of this invention may be noted the provision of an improved tamper-proof cover for the operating nut of a fire hydrant which will prevent the use of the hydrant by all except those having a special operating socket; the provision of such a cover which allows for drainage of water around the operating nut thereby preventing corrosion of the nut; and the provision of such a cover which is simple in construction, inexpensive to manufacture and easy to use.

Generally, a tamper-proof cover of the present invention for the operating nut of a fire hydrant comprises a housing and an operating member. The housing has an internal flange and is adapted to be positioned on the bonnet of the hydrant over and around the operating nut so that the operating nut is substantially concealed. The operating member has an opening therein for receiving the nut and is adapted to be placed on the operating nut within the housing, the opening in the operating member having a shape generally corresponding to that of the nut for preventing relative rotation between the operating member and the operating nut when the operating member is on the nut. The cover further comprises means for securing the operating member against removal from the operating nut, the flange of the housing being engageable with the operating member when the latter is secured to the nut for preventing removal of the housing from the bonnet.

In another aspect of this invention, the tamper-proof cover includes a socket for turning the aforementioned operating member and operating nut. The socket has an opening therein for receiving at least a portion of the operating member with a shape generally corresponding to that of the portion of the operating member for preventing relative rotation between the socket and the operating member. The socket is adapted to be placed on the operating member within the housing.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 3:
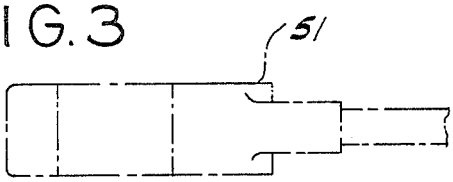
FIG. 3 is an exploded view of the tamper-proof cover with parts broken away, the bonnet, operating nut and a wrench being shown in phantom.

Referring now to the drawings, there is indicated at 1 a tamper-proof cover for the operating nut 3 of a fire hydrant. The fire hydrant includes a standpipe (not shown) and a bonnet 5 at the top of the standpipe. The operating nut 3 is fabricated of steel or the like and extends upwardly from the top of the bonnet. The nut is usually pentagonal in shape, however the shape of the nut is not critical to this invention and could be of any shape.

Figure 2:
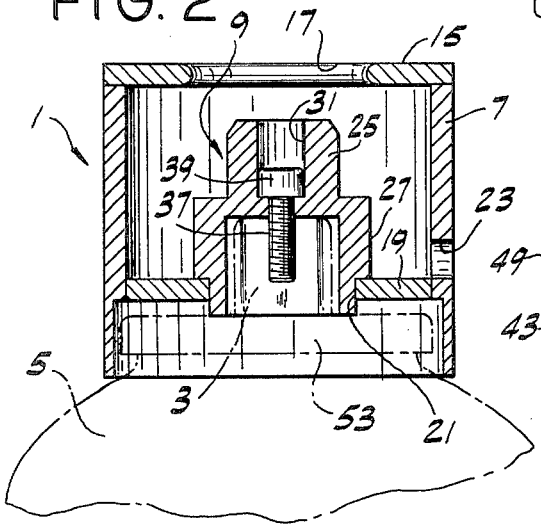
FIG. 2 is an enlarged vertical section of the tamper-proof cover shown in FIG. 1.
Figure 2:
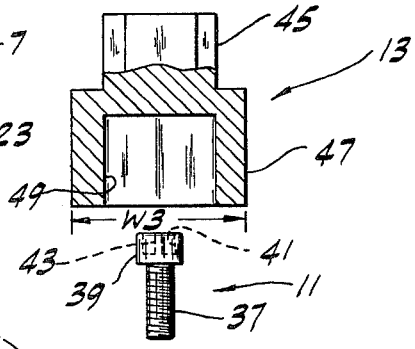
Figure 2:
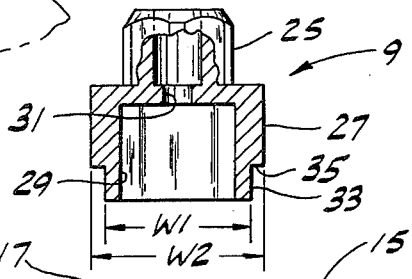
Figure 1:
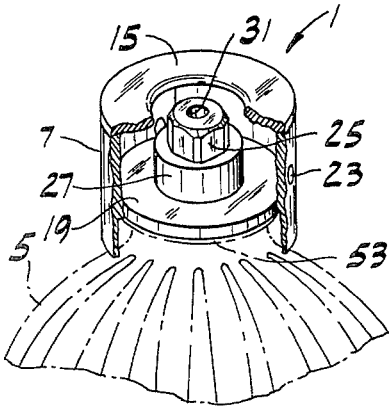
FIG. 1 is a perspective of a tamper-proof cover of this invention on the bonnet of a fire hydrant (shown in phantom), parts of the cover being broken away to illustrate details.
Figure 1:
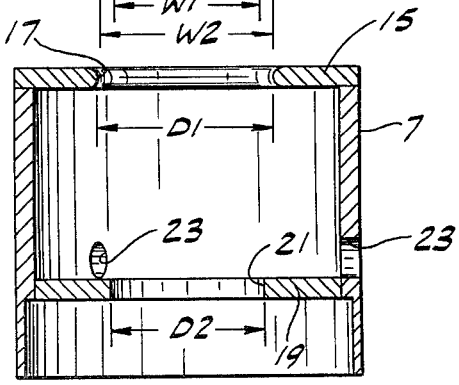
Figure 1:
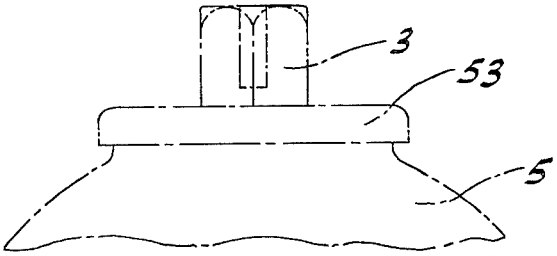

As shown in FIG. 2, the cover 1 comprises a housing 7 positioned on the bonnet 5 over and around the operating nut 3 so that the operating nut is substantially concealed, an operating member 9 on the operating nut within the housing and means comprising a screw 11 for securing the operating member against removal from the operating nut. A socket 13 (FIG. 3) is provided for turning the operating member and the operating nut, as will appear.

More particularly, the housing 7 is generally cylindrical in shape, having a top wall 15 and an open bottom. A central opening 17 having a diameter D1 is provided in the top wall. The housing also has an internal annular flange 19 toward its lower end. The opening 21 bounded by flange 19 has a diameter D2 which is less than the diameter D1 of opening 17 but greater than the width of the operating nut 3. A plurality of ports 23 are formed in the body of the housing above the internal flange for the drainage of water from the housing.

The operating member 9 has an upper portion 25 and a lower portion 27 with an opening or recess 29 in the lower portion for receiving the nut 3. Recess 29 is a shape generally corresponding to that of the nut 3 thereby to prevent relative rotation between the operating member 9 and the nut 3 when the operating member is on the nut. The operating member 9 also has a vertical passage or bore 31 through its upper and lower portions for receiving screw 11, the bore being counterbored in the upper portion for receiving the head of the screw. The lower portion 27 of the operating member 9 has an external groove 33 around its lower end resulting in a downwardly-facing shoulder 35, the width W1 of the lower portion 27 below the shoulder being less than diameter D2 of opening 21 and the wicth W2 of the lower portion 27 above the shoulder being greater than diameter D2 but less than diameter D1 of opening 17. These dimensions enable the operating member to be passed through opening 17 of the housing and shoulder 35 to be engageable with the flange 19 for preventing removal of the housing from the bonnet. The upper portion 25 is the same shape as the operating nut. The top of the upper portion 25 of the operating member is bevelled to hinder the use of make-shift tools by would-be vandals to turn the operating member.

The head of screw 11 has a hexagonally shaped recess 41 centrally located therein with a nipple 43 in the center thereof. A special tool (not shown) in the shape of an allen wrench with a bore in one thereof is used to turn the screw to thread it into the operating nut 3 of the hydrant.

The socket 13, like the operating member 9, has an upper portion 45 and a lower portion 47. The lower portion has an opening or recess 49 therein of a shape generally corresponding to that of the upper portion 25 of the operating member 9 for preventing relative rotation between the socket and the operating member when the socket is placed on the operating member. The upper portion 45 is preferably in the shape of the operating nut so that tools presently used to turn the operating nut can also be used with this invention. However, it will be understood that the upper portion 45 may be of any shape. The width W3 of the lower portion of the socket is less than the diameter D1 of the opening 17 in the top wall 15 of the housing 7 thereby allowing the socket to be positioned on the operating member when the operating member is within the housing. However, the height of the socket 13 is such that the upper portion 45 of the socket extends above the top wall 15 thereby allowing a wrench, such as the one shown at 51 in FIG. 3, to be used to turn the socket.

In the operation of this invention, the housing 7 is first placed on top of the bonnet 5 of the fire hydrant in a position wherein it shields the cap 53 of the hydrant and encloses the operating nut 3 therein. Next, the operating member 9 is placed on the operating nut 3 in the housing. Screw 11 is then inserted through bore 31 in the operating member and threaded into the operating nut 3. The head of the screw being disposed within the counterbored portion of bore 31 to secure the operating member against removal from the operating nut. The securement of the operating member also secures the housing 7 in position by the engagement of flange 19 with shoulder 35. Suitable material, such as steel wool, may be stuffed into the counterbored portion of the operating member and lead or solder melted thereon to prevent easy access to the screw for removal thereof. At this point, the operating member and operating nut are substantially concealed within the housing and protected from vandalism. Since conventional sockets are not adaptable for use with pentagonally shaped nuts, a special tool must be used to turn the operating member 9 which in turn will turn the operating nut 3. Socket 13 is used for this purpose. When it is necessary to open the hydrant, the socket is placed on the top of the operating member with the latter being received in recess 49. With the upper portion 45 of the socket extending above the top closure, a conventional wrench 51 can be used to open and close the hydrant.

It will be understood from the above description that the use of the tamper-proof cover 1 provides a simple and economical method of preventing vandals from tampering with the operating nut of the fire hydrant.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. A tamper-proof cover for the operating nut of a fire hydrant, the hydrant including a standpipe and a bonnet at the top of the standpipe, the operating nut extending upwardly from the bonnet, said cover comprising:

a housing adapted to be positioned on the bonnet over and around the operating nut so that the operating nut is substantially concealed, said housing having an internal flange which extends radially outwardly into the housing;

operating member having an opening therein for receiving the nut, said opening having a shape generally corresponding to that of said nut for preventing relative rotation between said operating member and the operating nut when said operating member is on the nut, said member being adapted to be placed on the operating nut within said housing; and means for securing said operating member against removal from the operating nut, said flange of the housing having an opening for receiving at least a portion of the operating member therein and being engageable with the operating member when the latter is secured to the nut for preventing removal of the housing from the bonnet.

2. A tamper-proof cover as set forth in claim 1 wherein said operating member has a lower portion and an upper portion, said operating member opening being in said lower portion, said operating member further having a passage through said upper and lower portions, said securing means comprising a screw adapted to be inserted through said passageway and threaded into the operating nut, the screw being engageable with the upper portion of the operating member thereby to secure said operating member against removal from the operating nut.

3. A tamper-proof cover as set forth in claim 2 wherein said lower portion of the operating member has an external groove therein resulting in a shoulder, the flange being engageable with the shoulder for preventing removal of the housing from the bonnet.

4. A tamper-proof cover as set forth in claim 3 wherein said upper portion of the operating member is in the shape of a nut for engagement by a wrench or the like for turning the operating member and operating nut.

5. A tamper-proof cover as set forth in claim 4 wherein the periphery of the top of said upper portion of the operating member is bevelled.

6. A tamper-proof cover as set forth in claim 5 wherein said upper portion is the same shape as the operating nut.

7. A tamper-proof cover as set forth in claim 1 wherein said housing has an opening in the top thereof greater in diameter than said operating member for enabling said operating member to be placed on the operating nut.

8. A tamper-proof cover as set forth in claim 7 wherein said housing has a plurality of ports above said internal flange for the drainage of water from the housing.

9. A tamper-proof cover for the operating nut of a fire hydrant, the hydrant including a standpipe and a bonnet at the top of the standpipe, the operating nut extending upwardly from the bonnet, said cover comprising:

a housing adapted to be positioned on the bonnet over and around the operating nut so that the operating nut is substantially concealed, said housing having an internal flange which extends radially outwardly into the housing;

an operating member having an opening therein for receiving the nut, said opening having a shape generally corresponding to that of the nut for preventing relative rotation between said operating member and the operating nut when said operating member is on the nut, said member being adapted to be placed on the operating nut within said housing;

means for securing said operating member against removal from the operating nut, said flange of the housing having an opening for receiving at least a portion of the operating member therein and being engageable with the operating member when the latter is secured to the nut for preventing removal of the housing from the bonnet; and a socket for turning the operating member and operating nut having an opening therein for receiving at least a portion of said operating member, said socket opening having a shape generally corresponding to that of said portion of said operating member for preventing relative rotation between said socket and said operating member, said socket being adapted to be placed on the operating member within said housing.

10. A tamper-proof cover as set forth in claim 9 wherein said operating member has a lower portion and an upper portion, said operating member opening being in said lower portion, said operating member further having a passage through said upper and lower portions, said securing means comprising a screw adapted to be inserted through said passageway and threaded into the operating nut, the screw being engageable with the upper portion of the operating member to secure said operating member against removal from the operating nut.

11. A tamper-proof cover as set forth in claim 10 wherein said lower portion of the operating member has an external groove therein resulting in a shoulder, the flange being engageable with the shoulder for preventing removal of the housing from the bonnet.

12. A tamper-proof cover as set forth in claim 11 wherein the periphery of the top of said upper portion of the operating member is bevelled.

13. A tamper-proof cover as set forth in claim 12 wherein said upper portion of the operating member is the same shape as the operating nut.

14. A tamper-proof cover as set forth in claim 9 wherein said housing has an opening in the top thereof greater in diameter than said operating member for enabling said operating member to be placed on the operating nut.

15. A tamper-proof cover as set forth in claim 14 wherein said housing has a plurality of ports above said internal flange for the drainage of water from the housing.

16. A tamper-proof cover as set forth in claim 9 wherein said socket has a lower portion and an upper portion, said socket opening being in said socket lower portion and said socket upper portion being the shape of a nut, the width of said socket being less than the diameter of the opening in the top of the housing for enabling said socket to be placed on the operating member within said housing, said socket upper portion further being sized so that when said socket is placed on said operating member said socket upper portion projects above the top of the housing.

17. A tamper-proof cover as set forth in claim 16 wherein said upper portion of the socket is of the same shape as the operating nut.

* * * * *